US006664936B2

(12) United States Patent
Ieda et al.

(10) Patent No.: US 6,664,936 B2
(45) Date of Patent: Dec. 16, 2003

(54) LOOP ANTENNA DEVICE

(75) Inventors: Kiyokazu Ieda, Aichi-ken (JP); Yuichi Murakami, Aichi-ken (JP); Satoshi Muramoto, Tokyo-to (JP); Eiji Mushiake, Aichi-ken (JP)

(73) Assignee: Aisin Seiki Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 09/785,471

(22) Filed: Feb. 20, 2001

(65) Prior Publication Data

US 2001/0026244 A1 Oct. 4, 2001

(30) Foreign Application Priority Data

Feb. 18, 2000 (JP) ..... 2000-041626

(51) Int. Cl.[7] ..... H01Q 7/00
(52) U.S. Cl. ..... 343/866; 343/713; 343/867
(58) Field of Search ..... 343/866, 867, 343/787, 788, 742, 713; 336/182, 184, 220, 221, 229, 117, 147, 170, 172, 180, 183; H01Q 7/00

(56) References Cited

U.S. PATENT DOCUMENTS 3,659,094 A * 4/1972 Nakahara et al. ..... 246/1 R
4,679,052 A * 7/1987 Ohe et al. ..... 343/712
5,495,213 A * 2/1996 Ikeda ..... 333/181
6,154,179 A * 11/2000 Kohno ..... 343/719
6,163,305 A * 12/2000 Murakami et al. ..... 343/788
6,181,130 B1 * 1/2001 Hoshi et al. ..... 324/253
6,229,492 B1 * 5/2001 Lee et al. ..... 343/713
6,259,412 B1 * 7/2001 Duroux ..... 343/711

FOREIGN PATENT DOCUMENTS

DE 41 05 826 A 1 2/1991
GB 2 243 955 A 11/1991

* cited by examiner

*Primary Examiner*—Don Wong
*Assistant Examiner*—Trinh Do Dinh
(74) *Attorney, Agent, or Firm*—Sughrue Mion, PLLC

(57) ABSTRACT

A loop antenna device has a first antenna generating a first magnetic field and a second antenna generating a second magnetic field such that the first magnetic field and the second magnetic field each have a different axis. A series resonant circuit and a parallel resonant circuit are provided for the first antenna and the second antenna, respectively. The series resonant circuit has at least a second coil, a link coil wound around a ferrite core, and a capacitor in series. The parallel resonant circuit has a first coil and a capacitor. When one of the first and second antennas are disposed in the vicinity of a conductor, an electromagnetic wave absorbing member is disposed between a conductor and one of the first and second antennas.

12 Claims, 4 Drawing Sheets

LOOP ANTENNA DEVICE

BACKGROUND OF THE INVENTION

1. Field of the Invention

The present invention is directed to a loop antenna device for generating a magnetic field. The loop antenna device is adapted to be disposed as an antenna in the vicinity of a conductor made of metal.

2. Related Art

One of the conventional loop antenna devices is disclosed in German Patent Publication DE 41 05 826 A1. The conventional loop antenna device includes a first antenna A1 and a second antenna A2. The first antenna A1 has a coil L2 wound around a ferrite rod and a resonant capacitor C2 connected thereto in parallel which constitutes a parallel resonant circuit. The second antenna A2 has a circular coil L1 accommodating therein the ferrite bar B and a resonant capacitor C1 connected in parallel with the circular coil L1 which constitutes a parallel resonant circuit. The ferrite rod 52 is also wound with coil L3 to which an amount of current is fed from a power source S.

In the foregoing structure, the ferrite rod 52 is rotated through an angle so as to establish a magnetic coupling between the first antenna A1 and the second antenna A2.

FIG. 6(*b*) of the present application shows an equivalent circuit of a conventional structure as shown in FIG. 6(*a*). In this case, when the loop antenna device is oscillated by a power supply S, a magnetic field component Hz is generated by the coil L1 and makes an angle of 90 degrees relative to a magnetic field component Hy generated by the coil L2. It is to be noted that the magnetic field component Hz and the magnetic field component Hy extend in the z-direction and y-direction, respectively.

For example, when the loop antenna device 51 is part of a key-less entry system, the loop antenna device 51 is disposed in a door handle of a vehicle. In this case, since a magnetic field component has a plurality of axial components, the axial components cross in an orthogonal manner relative to the conductor such as the door parts. As shown in FIG. 7, the loop antenna device 51 is fixed such that the magnetic field component Hz crosses in an orthogonal manner relative to the conductor plate such as a door part in the vicinity of the conductor plate 57.

When the loop antenna device 51 is used for one part of a key-less entry system, the loop antenna device is disposed in spaced apart relation to the conductor plate 57 at a predetermined distance in order to secure an antenna characteristic. Otherwise, when the loop antenna device 51 is disposed in the vicinity of the conductor plate 57, the loop antenna device 51 is assembled by adjusting an antenna constant. In the condition shown in FIG. 7, when the power supply is oscillated, a radiation magnetic field Hz in a z-direction is generated on an inner portion of the coil. Then, as the magnetic field component −Hz is reflected by the conductor plate 57, the reflected magnetic field component (e.g., Hz) is denied by the magnetic field component −Hz generated by the coil. The loop antenna may be disposed apart from the conductor 57 in order to avoid the above-mentioned problem, however, if the loop antenna 51 is disposed apart from the conductor 57, it is necessary that the thickness of the door handle on a direction perpendicular to the vehicle door comes wider whereby the size of the vehicle door having the door handle becomes too large.

SUMMARY OF THE INVENTION

It is, therefore, one of the objects of the present invention to provide a loop antenna device without the forgoing drawbacks.

It is another object of the present invention to provide a loop antenna device having a radiated magnetic field generated by the coil of the loop antenna device when the loop antenna device is disposed in the vicinity of a conductor.

In order to attain the foregoing objects, a loop antenna device located close to a conductor includes an antenna for generating a magnetic field component perpendicular to the conductor, and an electromagnetic absorbing member disposed between the antenna and the conductor.

Further, a loop antenna device includes a first antenna having a first resonant circuit comprised by a first coil and a first condenser connected to the first coil, a second antenna including a second resonant circuit comprised by a second coil wound in a direction perpendicular to the wound direction of the first coil outside of the first antenna, a link coil wound in the same wound direction of the first coil and connected to the second coil, and a second condenser connected to the link coil, a case made of a conductor material accommodating the first antenna and the second antenna, and an electromagnetic wave absorbing member disposed between the case and at least one of the first coil and the second coil.

BRIEF DESCRIPTION OF THE DRAWINGS

The above and other objects, features and advantages of the present invention will be more apparent and more readily appreciated from the following detailed description of preferred exemplary embodiments of the present inventions, taken in connection with the accompanying drawings, in which;

FIG. 3(*b*) is an equivalent circuit of the structure shown in FIG. 3(*a*);

FIG. 6(*b*) is an equivalent circuit of the structure shown in FIG. 6(*a*);

DETAILED DESCRIPTION OF THE PRESENT INVENTION

A preferred embodiment of the present invention will be described hereinafter in detail with reference to the accompanying drawings from FIG. 1 to FIG. 5.

Figure 2:
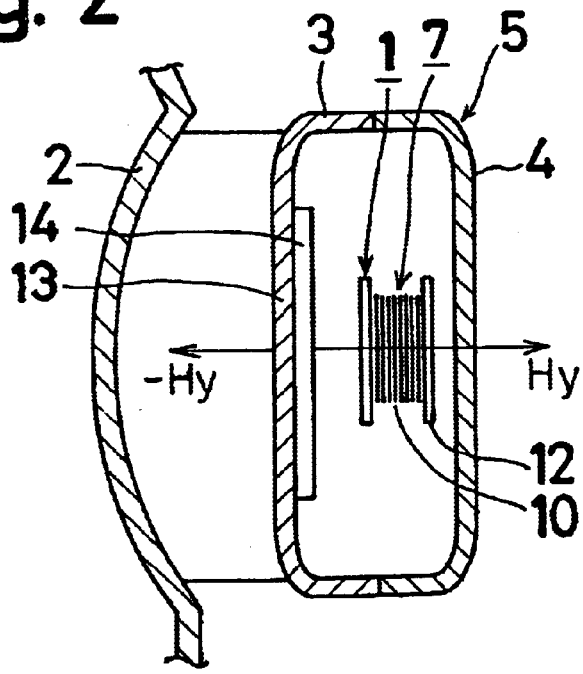
FIG. 2 is a cross-sectional view of a door handle showing a magnetic field component radiated from a coil of an antenna in accordance with the present invention.
Figure 4:
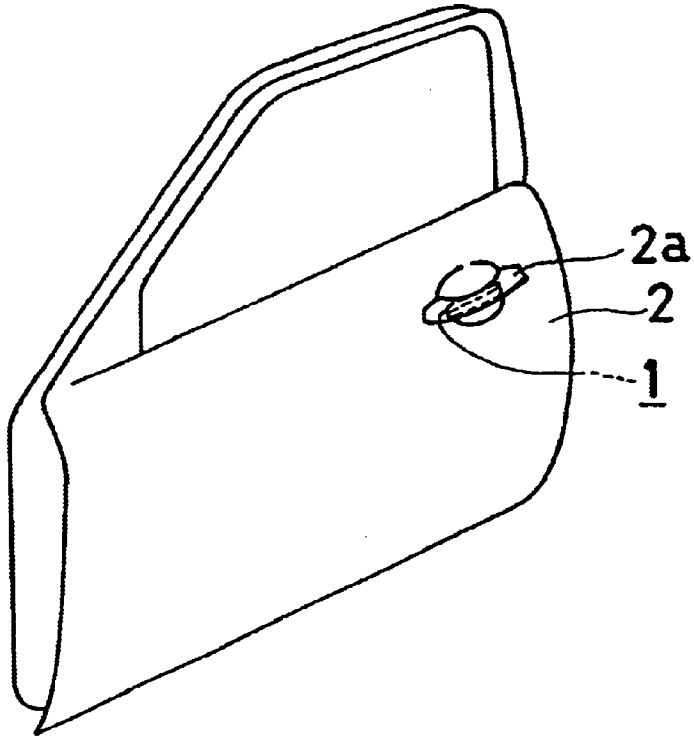
FIG. 4 is a perspective view of a vehicle door when a loop antenna device is adapted as an antenna of the vehicle in accordance with the present invention.

As shown in FIG. 2 and FIG. 4, a loop antenna device 1 is an antenna (a transmitting antenna) used, for example, in a key-less entry system of a vehicle, the loop antenna device 1 being especially adapted to a smart entry system of the vehicle. The loop antenna device 1 is disposed in a door handle 2*a* of a vehicle door 2. Hereinafter, the vehicle part corresponds to a door handle 2*a*. The door handle 2*a* includes a body case 5 comprised of a door handle case 3 made of conductive material (e.g., iron) and a door handle case 4 made of resin, the door handle case 4 made of resin is disposed against an outside surface of the vehicle door 2.

Figure 1:
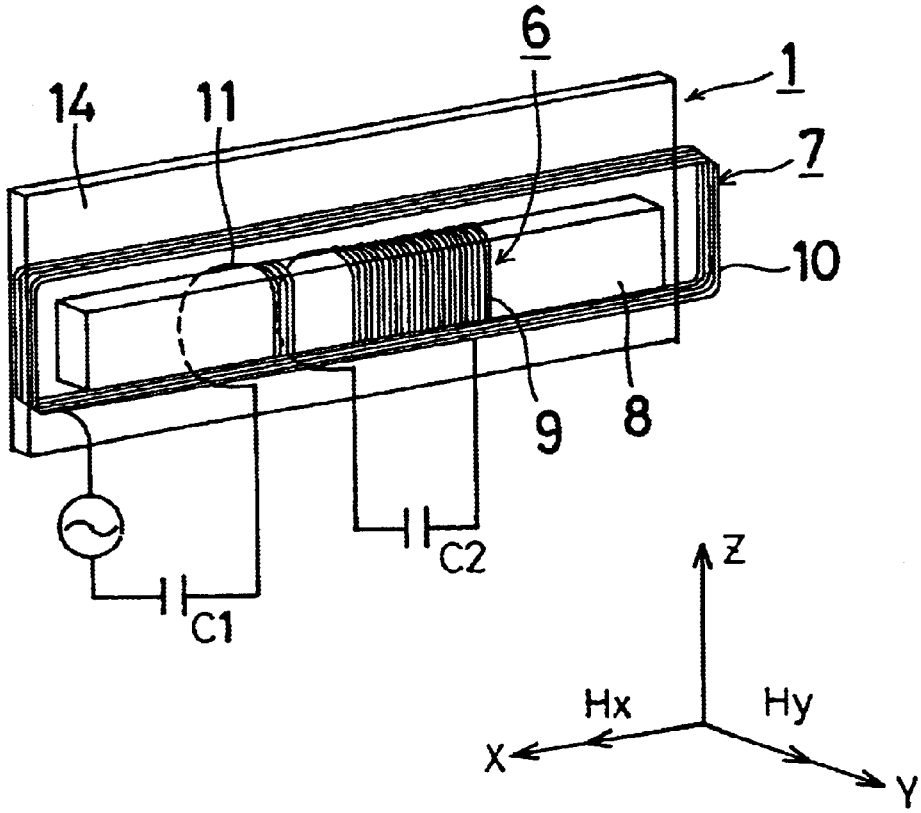
FIG. 1 is a perspective view of a first embodiment of a loop antenna device in accordance with the present invention.
Figure 3A:
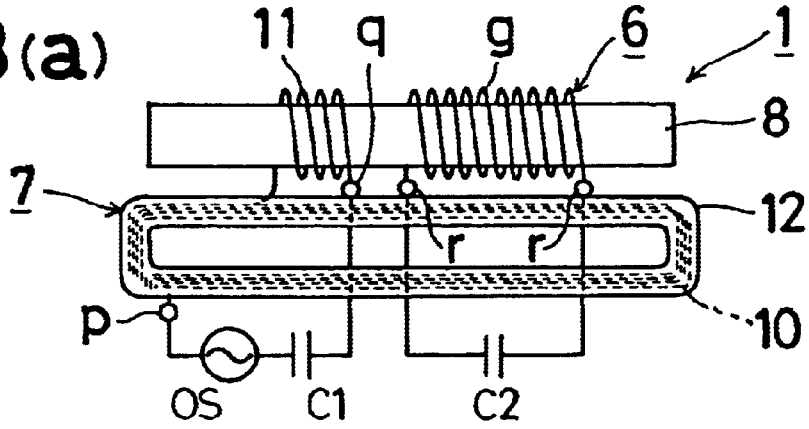
FIG. 3(*a*) is a view for explaining in detail how to wind the first coil of a first antenna, a second coil of a second antenna, and a link shown in FIG. 1.
Figure 3B:
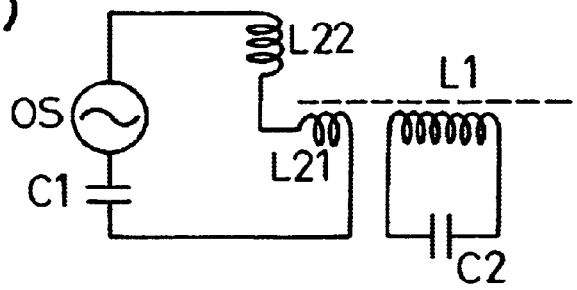

Referring to FIG. 1 and FIG. 3, a loop antenna device 1 has a first antenna 6 and a second antenna 7. The first antenna 6 includes a first coil 9 wound around a thin rectangular prism ferrite core (ferrite member) 8. The first coil 9 is formed of a good electric conductive material such as cooper wound a direction orthogonal to a longitudinal direction of the ferrite core 8. The ferrite core 8 is made of Mn—Zn or NI—Zn material in order to increase the antenna efficiency. The ferrite core 8 may be formed into a thin round or prism configuration.

The second antenna 7 includes a second coil 10 in a circular shape extending in the longitudinal direction of the ferrite core 8 outside the first coil 9 of the first antenna 6, and a link coil 11 extending from one end of the second coil 10 is wound a predetermined number of times around the ferrite core 8. That is, one end portion of the second coil 10 is extended to one end portion of the ferrite core 8 and is wound a predetermined number of times therearound so as to constitute a link coil 11. Concretely, as shown in FIG. 2, the second coil 10 is wound around a bobbin 12 formed of a resin such as an ABS synthetic resin or polycarbonate (PC) resin. Thus, as can be seen from FIG. 1, the first coil 6 and the link coil 11 are wound around the ferrite core 8 (x-direction), the second coil 10 is wound around the ferrite core 8 (y-direction), but the first coil 9 and the link coil 11 may be wound in an orthogonal manner around a bobbin 12 including the ferrite core 8. The second coil 10 is wound around the first coil 9 of the first antenna 6, the second coil 10 is disposed in a condition which is spaced apart from the first coil 9. That is, the second antenna 10 is so configured as to be a closed rectangular loop member having at its center portion a rectangular opening in which the ferrite core 8 is placed such that a clearance is defined therebetween. The ferrite core 8 is in common with the first coil 9 and the second coil 10.

FIGS. 3(*a*) and (*b*) provides views for explaining the structure of the loop antenna device 1. FIG. 3(*a*) indicates conceptually a plan view showing how the first coil 9 of the first antenna 6 is wound, the second coil 10 and the link coil 11 of the second antenna 7 are wound around the ferrite core 8. FIG. 3(*b*) indicates an equivalent circuit of the structure shown in FIG. 3(*a*). In FIG. 3(*b*), reference symbols, L1, L21, and L22 show inductances of the first coil 9, the second coil 10, and the link coil 11, respectively. Concerning the shape of the structure of the loop antenna device 1, the outer configuration of the loop antenna device 1 shall not be determined from the illustration of FIG. 3.

As shown in FIGS. 3(*a*) and (*b*), a resonant capacitor (e.g., a condenser) C1 and a power supply (e.g., an oscillator) OS are connected in series between a terminal p of the second coil 10 of the second antenna 7 and a terminal q of the link coil 11, and a capacitor C2 is connected between both terminal ends r, r of the first antenna 6. Therefore, the second antenna 7 takes the form of a series resonant circuit in which the second coil 10, the link coil 11, the power supply OS, and the resonant capacitor C1 are connected in series. In addition, the first antenna 6 takes the form of a parallel resonant circuit which the first coil 9 and the resonant capacitor C2 are connected in parallel. A coupling level between the first antenna 6 and the second antenna 7 is variable according to the number of windings of the link coil 11 around the ferrite core 8. In addition, the resonant capacitor C2 is established so as to resonate in parallel using the frequency of the power supply OS, the resonant capacitor C1 is also established so as to resonate in series using the same frequency.

If a voltage is applied from the power supply (oscillator) OS to the second antenna 7 and the power supply OS is oscillated, a current flows in the first coil 9 as the first coil 9 of the first antenna 6 is excited. Therefore, as shown in FIG. 2, a magnetic field (magnetic field component) Hx in an x-direction is generated by the link coil 11 and the first coil 9 of the first antenna 6 while the power supply OS of the second antenna 7 oscillates, and a magnetic field Hy in a y-axis direction is generated by the second coil 10 of the second antenna 7. If a voltage is applied from the power source OS to the second antenna 7, an axis (a y-axis) of a magnetic field component generated by the second antenna 7 and an axis (a x-axis) of a magnetic field component generated on the first antenna 6 make an angle of 90 degrees to each other.

As shown in FIG. 1 and FIG. 2, an electromagnetic wave absorbing sheet (radio-wave absorber) 14 for absorbing the electromagnetic wave is fixed by a double-sided adhesive tape on an inner surface of a conductor (a conductor plate) 13 fixed an inner surface of the door handle 2*a*, and the electromagnetic wave absorbing sheet 14 is disposed between the first antenna 6 (or the second antenna 7) and a conductive plate 13 which is part of the door handle case 3. The electromagnetic wave absorbing sheet 14 is made up of a magnetic powder and a rubber member forming an insulator layer. The electromagnetic wave absorbing sheet 14 is made of e.g., Fe—Si—Al alloy and polyethylene thermoplastic elastomer (BUSTERAID produced by TOKIN Co.), or Mn/Zn ferrite and EPDM (Ethylene Propylene copolymer Ethylene propylene diene terpolymer; FLEXIELD (IR-B02) produced by TDK Co.), Mn/Mg/Zn ferrite and soft polyvinyl chloride (FLEXIELD (IV-M) produced by TDK Co.), etc. The magnetic wave absorbing sheet 14 may be used with another electromagnetic wave absorbing member which absorbs an electromagnetic wave. The material of the electromagnetic wave absorbing sheet 14 may use paints for absorbing the electromagnetic wave instead of the above-mentioned magnetic power and the rubber. The size of the electromagnetic absorbing sheet 14 is at least as wide as a domain of the magnetic field generated by the second coil 10 of the second antenna 7 and has a thickness of about 1 mm.

Next, the functions of the loop antenna device 1 of the above-mentioned structure will be explained as follows.

For example, as shown in FIG. 2, if the loop antenna device 1 is disposed within the door handle 2*a* so as to parallel to the winding direction of the second coil 10 of the second antenna 7 against the conductor plate 13, the magnetic field Hx is generated by the first coil 9 and the magnetic field Hy is generated by the second coil 10 when the power supply OS oscillates. As a result, a radiation pattern (a radiated direction) of the magnetic field Hy crosses the conductor plate 13 in an orthogonal manner. However, FIG. 2 illustrates only the magnetic field of the y-axis direction. The magnetic field −Hy is difficult to generate on the conductor plate 13 side as a magnetic field −Hy radiated toward a reverse side of the magnetic field Hy (the conductor plate 13 side) is absorbed by the electromagnetic wave absorbing sheet 14. Therefore, the magnetic field Hy generated by the second coil 10 is not 15 disturbed, the magnetic field Hy is not effected by the electromagnetic wave absorbing sheet 14. For example, when the loop antenna device 1 is used for a device (e.g., an antenna for a key-less entry system) which is able to be controlled by a remote operation, sensitivity of the device is improved.

Figure 5:
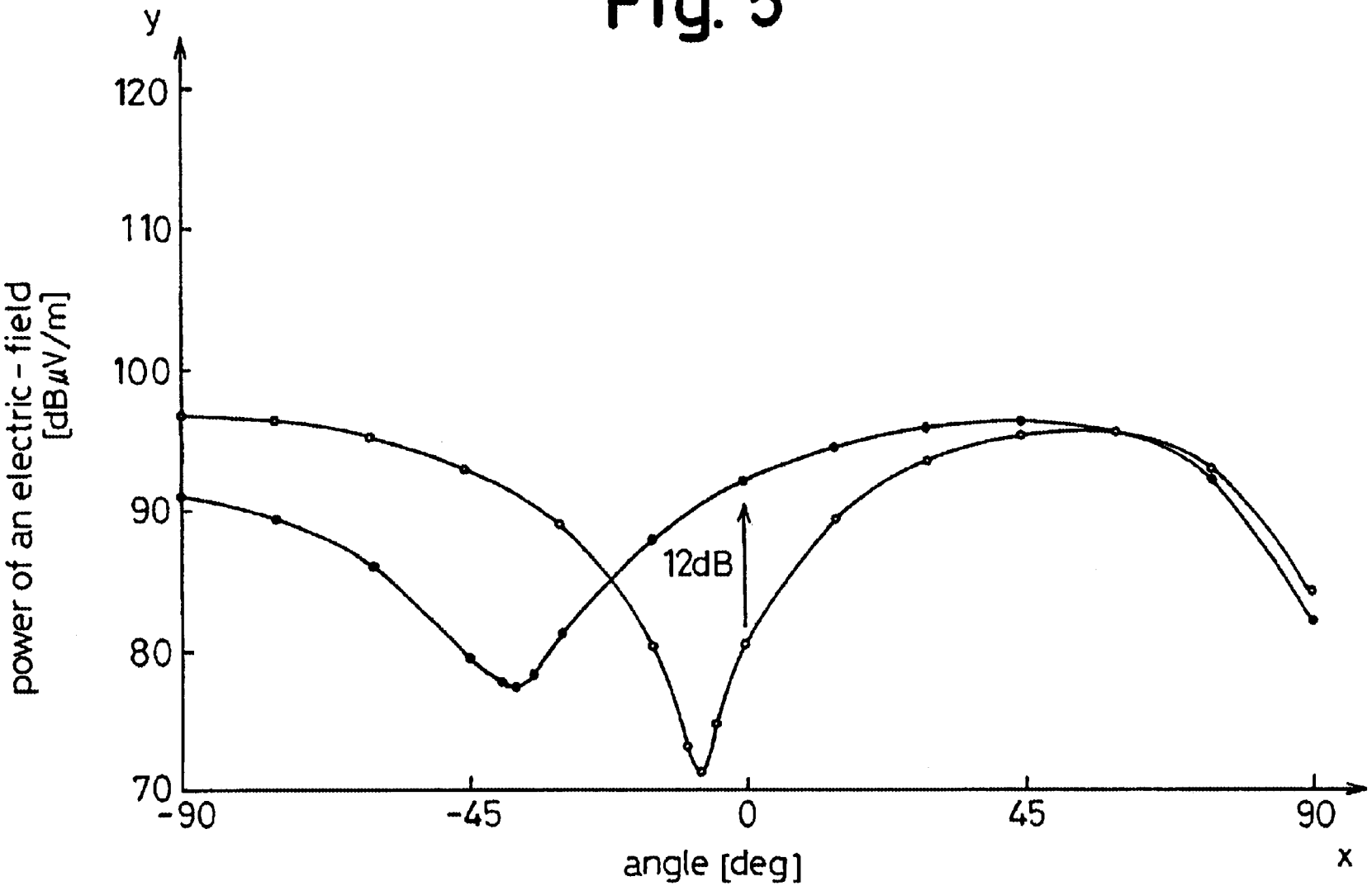
FIG. 5 is a graph shown in the intensity of an electric field for angles in accordance with the present invention.
Figure 6A:
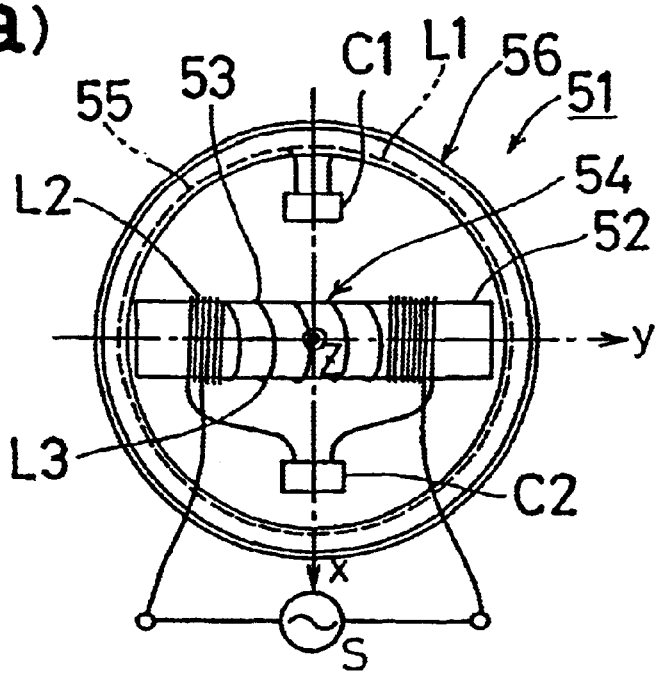
Fig. 6(a) Prior Art
FIG. 6(*a*) is a plan view which shows the structure in accordance with a conventional loop antenna device.
Figure 6B:
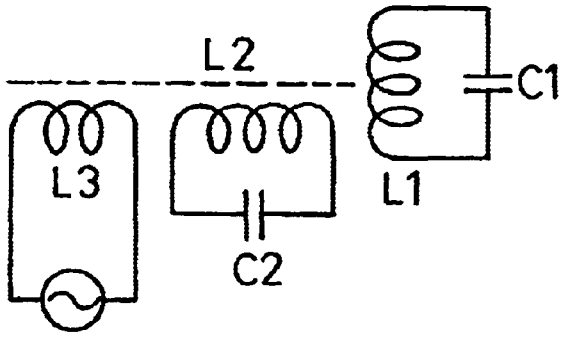
Fig. 6(b) Prior Art
Figure 7:
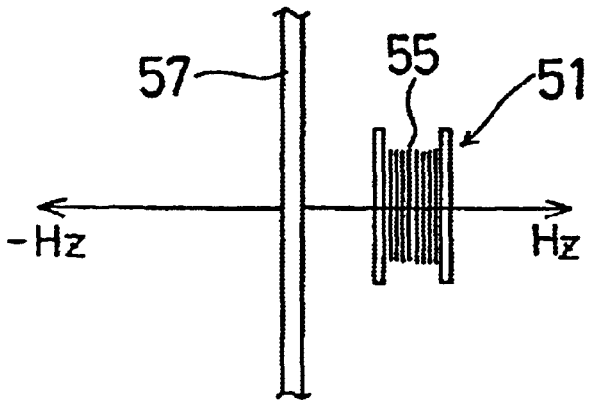
Fig. 7 Prior Art
FIG. 7 is a plan view for explaining a relationship between a magnetic field radiated by a coil of an antenna and a magnetic field component radiated toward a conductor in accordance with a conventional loop antenna device.

FIG. 5 is a graph showing a distribution of the magnetic field which shows the radiation pattern of an electric field component on an x-y plane. In FIG. 5, the abscissas (x-axis) shows the power of the magnetic field for wide angles θ (degree) in a horizontal direction when a direction perpendicular to the center of the conductor surface (a surface of the conductor plate 13) is 0 degrees, and the ordinate (y-axis) shows the power of the electric field (dB□ V/m). If value of the power of the electric field is greater, an average value of a power of the electric field is higher, the device 1 can have a high sensitivity. In FIG. 5, a solid line connecting open circles shows a condition when the electromagnetic wave absorbing sheet 14 is not disposed in the body case 5 of the door handle 2*a*, and a solid line connecting solid circles shows another condition when the electromagnetic wave absorbing sheet 14 is disposed between the conductor plate 13 and the loop antenna device 1 as shown in FIG. 2. In FIG. 5, when the power of the electric field is at an angle 0, the power of the electric field is greatly increased. Therefore, especially when the loop antenna device 1 is used with a key-less entry system, the antenna gain of the loop antenna device 1 is greatly improved as many users (e.g. drivers) operate a remote control at a position of 0 degree (a front position of the door handle 2*a*). Further, if the user operates a remote control device using a vehicle key (not shown) in a region spaced (e.g., a wide range: −30 to 30 degrees) from a center position of the door handle 2*a*, the detecting sensitivity of the radio-wave within the above-mentioned range is improved by the electromagnetic wave absorbing sheet 14. As a result, the loop antenna device 1 can have a better performance.

According to the above-mentioned structure, when the second coil 10 generating the magnetic field Hy is disposed in the vicinity (if a wave length λ of the magnetic field Hy, the vicinity is e.g., λ/10) of the conductor plate 13, the magnetic field −Hy is generated by a mirror symmetry phenomenon of the antenna according to a ground plan, however, in this embodiment, as the electromagnetic wave absorbing sheet 14 is disposed between the second coil 10 and the conductor plate 13, the magnetic field −Hy is to a certain extent absorbed by the electromagnetic wave absorbing sheet 14. Thus, the magnetic field Hy necessary for transmitting and receiving a radio wave is secured as the magnetic field −Hy toward the conductor plate 13 is restrained by the electromagnetic wave absorbing sheet 14. As a result, when the loop antenna device 1 is used for an antenna of a key-less entry device, the antenna efficiency (e.g., antenna gain) can be improved.

If the direction which is perpendicular to the conductor plate 13 by using the loop antenna device 1 is increased, the magnetic field Hy crosses in an orthogonal manner the conductor plate 13, and two axis components of the magnetic field can be secured by way of disposing the electromagnetic absorbing sheet 14 between the loop antenna device 1 and the conductor plate 13. Further, if the structure of the link coil is used, the above-mentioned effect can be achieved in the loop antenna device 1 by generating two axis magnetic field components perpendicular to each other.

When the loop antenna device 1 is used for a vehicle (e.g., automobile), if the loop antenna device 1 is disposed in the vicinity of a conductor (the conductor plate), the antenna efficiency can be maintained and it prevents the vehicle door from greatly affecting the efficiency if the electromagnetic absorbing sheet 1 is disposed between the loop antenna device 1 and the conductor plate 13.

When the electromagnetic absorbing member is an electromagnetic wave absorbing sheet 14, the door handle cases 3, 4 of the door handle 2*a* can be small and thin even though the electromagnetic wave absorbing sheet 14 is disposed between the loop antenna device 1 and the conductor plate 13. When the material of the electromagnetic wave absorbing sheet 14 is composed of magnetic powder and rubber, which is able to easily obtained, the loop antenna device 1 may be low cost and easy to use. Further, the electromagnetic wave absorbing sheet 14 is easy to fix adhesively even on a curved surface of the door handle etc. made of metal by deforming of the rubber member.

The electromagnetic wave absorbing member is not limited to an electromagnetic wave absorbing sheet 14, but may be another member (a metal plate or an amorphous thin film) which is able to absorb the electromagnetic wave.

The loop antenna device 1 is not limited for use with magnetic field components of two axis. For example, the loop antenna device may be adapted to a device generating a magnetic field component of only one axis by winding the coil around the ferrite core or it may be a device generating magnetic field components of more than three axis.

The loop antenna device 1 in this embodiment shows an antenna for transmitting a radio wave but it may be used as a receiving antenna connecting a detector detecting current flows on the second coil 10 and the link coil 11 instead of the power supply OS.

The second antenna 7 may be equipped with a parallel resonant circuit which connects in a parallel manner a capacitor C1 and the power supply OS instead of the series resonant circuit.

The electromagnetic wave absorbing member 14 may be assembled with the loop antenna device 1. A fixed position of the loop antenna device 1 is not limited on the inside portion of the conductor plate 13 of the door handle 2*a*. For example, the member may be fixed on the vehicle door made of metal if the door handle 2*a* is made of resin. In this case, the electromagnetic wave absorbing member is easy to secure since the vehicle door is usually made of iron.

The loop antenna device 1 is not limited to be used as the antenna of the key-less entry system of the vehicle, for example, the loop antenna device 1 may be adopted to a device which is capable of being controlled by a remote control using a radio wave.

The loop antenna device 1 is not limited for use on a vehicle. The device 1 may be adopted to a device controlled by the remote control using a radio-wave. Further, the device 1 may be adopted to another vehicle such as industrial vehicles etc., instead of the automobile.

The engineering ideas of this invention will be explained as follows.

The antenna device comprises at least the first antenna having the resonant circuit formed by the first coil wound around the ferrite core and the capacitor connected to the first coil, the second antenna 7 formed of the resonant circuit by the second coil wound in a direction perpendicular to the wound direction of the first coil 9 on the outside of the first antenna 9 and the capacitor C1. The wound directions of the first coil 9 and the second coil 10 cross in an orthogonal manner each other, the first coil 9 and the second coil 10 are wound around the ferrite. The wound direction of the second coil parallel 10 is parallel to the conductor 14. In this case, the wound direction of the second coil 10 is disposed in parallel manner against the conductor 14 when the loop antenna device 1 is disposed in the vehicle. Thereby, one magnetic field component of the loop antenna device 1 surely crosses in an orthogonal manner the conductor 14, but the magnetic field component Hy is surely generated and the antenna efficiency is improved as the electromagnetic wave absorbing member 14 is disposed between the loop antenna device 1 and the conductor 13.

The invention has thus been shown and described with reference to specific embodiments, however, it should be understood that the invention is in no way limited to the details of the illustrated structures but changes and modifications may be made without departing from the scope of the appended claims.

What is claimed is:

1. A loop antenna device located adjacent an outside surface of a vehicle, comprising:

a case disposed against the outside surface of the vehicle, an antenna disposed in the case and generating a magnetic field component perpendicular to the outside surface of the vehicle; and an electromagnetic absorbing member absorbing the magnetic field generated toward the outside surface of the vehicle and disposed between the antenna and the surface of the vehicle, wherein said electromagnetic absorbing member is selected from a group consisting of Fe—Si—Al alloy and polyethylene thermoplastic elastomer, Mn/Zn ferrite and Ethylene Propylene copolymer Ethylene propylene diene terpolymer, and Mn/Mg/Zn ferrite and soft poly-vinyl chloride.

2. The loop antenna device as set forth in claim 1, wherein the antenna including a first antenna generating a first magnetic field as well as a second antenna generating a second magnetic field, and the first magnetic field crosses perpendicular to the second magnetic field.

3. The loop antenna device as set forth in claim 2, wherein the first antenna including a first resonant circuit comprised by a first coil and a first condenser connected to the first coil;

the second antenna including a second resonant circuit comprised by a second coil wound in a direction perpendicular to a winding direction of the first coil on the outside of the first antenna, a link coil wound in the same winding direction as the first coil and connected to the second coil, and a second condenser connected to the link coil.

4. A loop antenna device comprising:

a first antenna including a first resonant circuit comprised by a first coil and a first condenser connected to the first coil;

a second antenna including a second resonant circuit comprised by a second coil wound in a direction perpendicular to a wound direction of the first coil on the outside of the first antenna, a link coil wound in the same wound direction of the first coil and connected to the second coil, and a second condenser connected to the link coil;

a case made of a conductor accommodating the first antenna and the second antenna, and an electromagnetic wave absorbing member absorbing the magnetic field generated toward the outside surface of the vehicle and disposed between the case and at least one of the first coil and the second coil, wherein said electromagnetic absorbing member is selected from a group consisting of Fe—Si—Al alloy and polyethylene thermoplastic elastomer, Mn/Zn ferrite and Ethylene Propylene copolymer Ethylene propylene diene terpolymer, and Mn/Mg/Zn ferrite and soft poly-vinyl chloride.

5. The loop antenna device as set forth in claim 4, wherein the first resonant circuit is a parallel resonant circuit, the second resonant circuit is one of a series resonant circuit and a parallel resonant circuit.

6. The loop antenna device as set forth in claim 4, wherein the electromagnetic wave absorbing member is a sheet.

7. The loop antenna device as set forth in claim 4, wherein the first coil and the second coil are wound around a ferrite core.

8. The loop antenna device as set forth in claim 4, wherein the loop antenna device is used for a vehicle and the case is a vehicle part made of a metal member.

9. The loop antenna device as set forth in claim 4, wherein the first and second antennas are disposed in a door handle.

10. A loop antenna device comprising:

a first antenna including a first coil for generating a first magnetic field;

a second antenna including a second coil for generating a second magnetic field such that an axis of the first magnetic field and an axis of the second magnetic field cross in an orthogonal manner to each other;

a link coil extending from one end of the second coil;

a case made of a conductor accommodating the first antenna and the second antenna; and an electromagnetic wave absorbing member absorbing the magnetic field generated toward the outside surface of the vehicle and disposed between the case and at least one of the first antenna and the second antenna, wherein said electromagnetic absorbing member is selected from a group consisting of Fe—Si—Al alloy and polyethylene thermoplastic elastomer, Mn/Zn ferrite and Ethylene Propylene copolymer Ethylene propylene diene terpolymer, and Mn/Mg/Zn ferrite and soft poly-vinyl chloride.

11. The loop antenna device as set forth in claim 10, wherein the electromagnetic wave absorbing member is a sheet.

12. The loop antenna device as set forth in claim 10, wherein the first coil and the second coil are wound around a ferrite core.

* * * * *